United States Patent [19]

Hahn et al.

[11] 4,232,822

[45] Nov. 11, 1980

[54] METHOD OF AND ARRANGEMENT FOR CORRECTING THE HEIGHT OF RAILWAY UPPER STRUCTURES

[75] Inventors: Volker Hahn, Leinfelden; Werner Fastenau, Esslingen-Rüdern, both of Fed. Rep. of Germany

[73] Assignee: Ed. Züblin Aktiengesellschaft, Stuttgart, Fed. Rep. of Germany

[21] Appl. No.: 864,605

[22] Filed: Dec. 27, 1977

[30] Foreign Application Priority Data

Dec. 28, 1976 [DE] Fed. Rep. of Germany ..... 2659161

[51] Int. Cl.[2] ..... E01B 1/00

[52] U.S. Cl. ..... 238/7; 104/11; 238/2

[58] Field of Search ..... 238/2, 3, 5, 6, 7, 8, 238/9, 372, 373; 104/11; 308/3 R; 29/428; 404/71, 77, 79

[56] References Cited

U.S. PATENT DOCUMENTS

| | | | |
|---|---|---|---|
| 966,793 | 8/1910 | Bush | 238/7 |
| 1,293,598 | 2/1919 | Wilson | 238/7 |
| 1,349,136 | 8/1920 | Lillard | 404/71 X |
| 1,350,760 | 8/1920 | Wilson | 238/7 |
| 1,738,043 | 12/1929 | Day | 238/9 |
| 2,132,571 | 10/1938 | Maney | 238/372 X |
| 2,367,146 | 1/1945 | Siebs | 238/7 UX |
| 2,875,953 | 3/1959 | Weber et al. | 104/11 X |
| 3,484,882 | 12/1969 | Blanchette | 308/3 R X |
| 3,790,078 | 2/1974 | Egerbork et al. | 238/2 |
| 3,878,987 | 4/1975 | Uzuka | 104/11 X |

FOREIGN PATENT DOCUMENTS

| | | | |
|---|---|---|---|
| 2244007 | 1/1974 | Fed. Rep. of Germany | 238/2 |
| 2354960 | 5/1975 | Fed. Rep. of Germany | 238/7 |
| 2365505 | 5/1975 | Fed. Rep. of Germany | 238/7 |
| 2354958 | 6/1975 | Fed. Rep. of Germany | 238/7 |

*Primary Examiner*—Randolph A. Reese

*Attorney, Agent, or Firm*—Becker & Becker, Inc.

[57] ABSTRACT

A method of and arrangement for correcting the height of a railway upper structure with a reinforced concrete plate thereon into which plate a reinforced concrete part as support for rail holding members is so inserted that the reinforced concrete part is positioned above a just finished or poured concrete section of the reinforced concrete plate in conformity with its end position and is subsequently lowered and jarred into the not yet hardened concrete of the reinforced concrete plate. For purposes of carrying out such height correction, first the finished part is disconnected from the supporting plate by detaching the bolts which interconnect the supporting plate and the finished part from each other and subsequently lifting the finished part, to which the rail holding members are connected by separate bolts, together with the rail section pertaining thereto by a distance required for the desired correction as a result of which a space or cavity is created between the finished part and the supporting plate. This space or cavity is then filled with a filler, and subsequently the finished part is again firmly connected to the supporting plate by means of bolts.

11 Claims, 2 Drawing Figures

METHOD OF AND ARRANGEMENT FOR CORRECTING THE HEIGHT OF RAILWAY UPPER STRUCTURES

Figure 1:
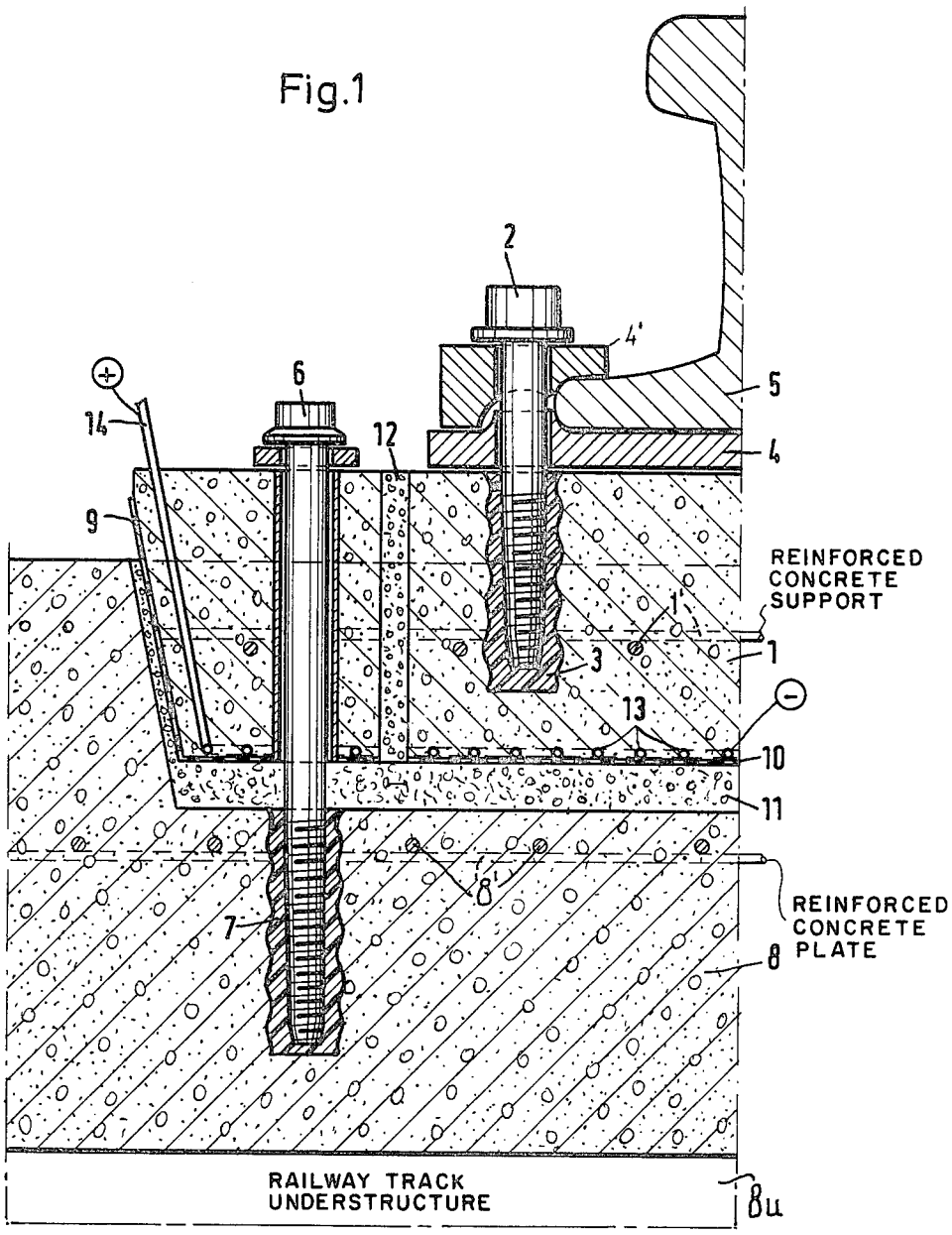

The present invention relates to a top of a railroad bed or a railway upper structure according to which finished parts as support for the rail mountings requiring an adjustment in height are inserted or imbedded in plates of reinforced concrete or steel concrete arranged on the substructure.

For preparing railway upper structures with reinforced concrete plates mounted on the under structure, in which finished parts of reinforced concrete are inserted for the rail mountings, it is known to position the finished parts of reinforced concrete above a just finished concrete section of the reinforced concrete plate in conformity with its end position and subsequently to lower the same and to ram it into the not yet hardened concrete of the reinforced concrete plate. In this connection, a plurality of finished reinforced concrete parts can be simultaneously positioned in the predetermined opposite locations. It is advantageous when the finished parts of reinforced concrete in their opposite locations are positioned at least in conformity with two reference points the connecting line of which extends parallel to the predetermined track axis.

While the tracks placed on the known classical gravel upper structure can without great difficulties be adjusted as to their height by pushing gravel therebelow, the adjustment as to height of gravel-free upper structures could not heretofore be carried out in a manner satisfactory to railway engineering requirements. This is particularly true for gravel-free railway upper structures which have been produced in conformity with the method set forth above.

Settling, as long as it is uniform has no great influence in open stretches upon the driving dynamics. However, as soon as the tracks change from, for instance, a poured dam or a poor bedrock or the like to a bridge or a tunnel, any settling causes the formation of steps which have to be compensated for by a height adjustment of the tracks in the track section adjacent to the respective building structure.

In connection with the gravel-free upper structure, primarily two methods have been suggested. The first method provides that steel plates of different thicknesses are placed below the track at the rail holding means. This is a possible way which, however, requires rather expensive rail servicing and additionally is time consuming. The second method consists primarily in lifting the entire supporting plate and to press in mortar therebelow. Also this method is very expensive. Moreover, the complete filling of the cavity below the plate is difficult to carry out and difficult to check.

It is, therefore, an object of the present invention to provide a simple method which can easily be carried out at low cost while still being a precise method for adjusting the height of rail bed upper structures which have been produced in conformity with the method referred to above.

These and other objects and advantages of the invention will appear more clearly from the following specification in connection with the accompanying drawings, in which:

FIG. 1 diagrammatically illustrates a section through a first embodiment of the finished part with supporting plate and rail holding means as employed in connection with the method set forth above.

Figure 2:
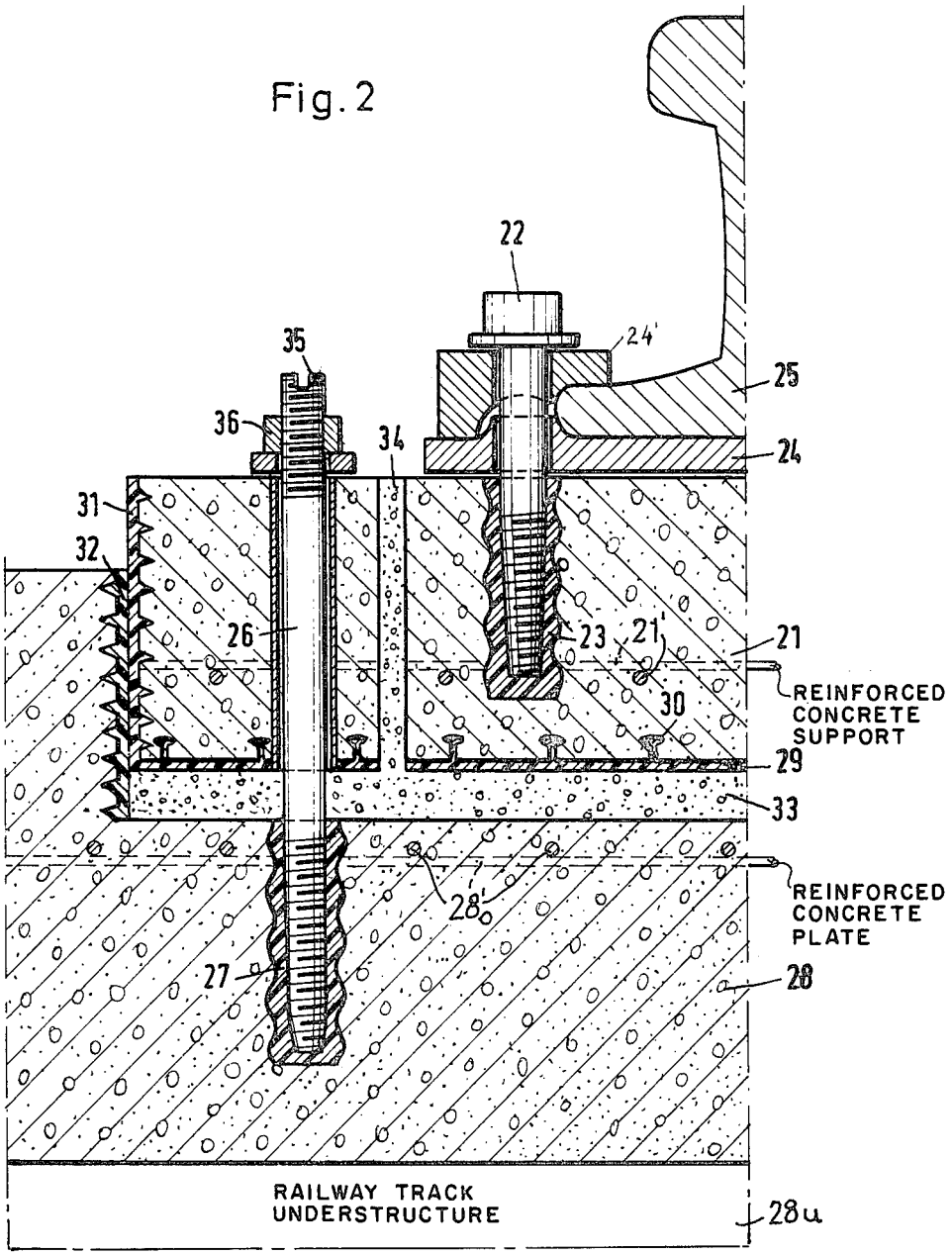

FIG. 2 is a section similar to that of FIG. 1 but of a different modification of the finished part employed in connection with the method set forth above.

According to the method and device for height adjustment of railway upper structures reinforced concrete plates mounted on the under structure have finished reinforced concrete parts as supports for the rail holding means. The finished reinforced concrete parts being so embedded or inserted into reinforced concrete are respectively positioned above a just finished concrete section of the reinforced concrete plates corresponding to its end position and subsequently lowered and jarred into the not yet hardened concrete of the reinforced concrete plate. First the finished part is detached from the supporting plate by disengagement of the bolts connecting said two parts. Subsequently, the finished part to which the rail holding means is connected by separate bolts is together with the rail lifted by a distance required for the necessary adjustment while the thus created space between the finished part and the supporting plate is filled with a hardening filling substance, for instance mortar. After the hardening of this filling substance, the finished part is again by means of bolts fixedly connected to the supporting plate. Instead of a hardenable mortar, also a thermoplastic material such a bitumin, tar, or similar substance may be used which by heating the same assumes a pourable condition and thus can be filled into the said space between the finished part and the supporting plate.

Instead of a hardenable mortar or a thermoplastic material, also sand, gravel, steel balls or other suitable material can be filled into said space between the finished part and the supporting plate when the finished part together with the rail is lifted.

For carrying out the method of the invention, it is expedient to design the lateral surfaces of the finished part so that it conically tapers in downward direction, and to coat the lateral surfaces and the bottom side with a separating medium. The tapering of the lateral surfaces and said separating medium make it possible that when the finished parts are produced in a smooth steel mold or form, the finished parts will detach themselves when lifting the track from its embedding in the supporting plate.

The loosening of the finished part can, according to the invention be facilitated by providing the bottom side of the finished part with a plate of synthetic material which has a smooth surface on that side thereof which faces the starting plate whereas that side which faces the finished part is for better adherence in the concrete of a rough nature and may be provided with protrusions which serve, so to speak, as an anchor in the concrete. The plate of synthetic material at the bottom side of the finished part which is intended to permit an easy disengagement of the finished part from the supporting plate, may simultaneously serve for improving the driving dynamics and the protection against noise. As synthetic material in this connection, e.g., soft polyvinyl chloride (PVC) may be used.

Providing the lateral surfaces of the finished part with a frame of synthetic material facilitates the lifting of the finished part without need for tapering the lateral surfaces. Also the frame of synthetic material should be smooth on one side and rough on the other side while the smooth side may be directed inwardly as well as outwardly. If the smooth side is directed outwardly, the frame of synthetic material will, during the lifting operation, remain on the finished part, whereas if the smooth side is directed inwardly, the frame of synthetic material remains in the supporting plate. As a suitable synthetic material, soft PVC or polyurethane, for example, may be used for the frame.

It is also expedient to surround the lateral surfaces of the finished part with a double walled frame of synthetic material. The inner surfaces of the frame which rest upon each other are smooth while its outersurfaces are rough and may be provided with projections serving as adhering anchors. When lifting the finished part, the outer frame remains embedded in the supporting plate, whereas the inner frame adheres to the finished part. When lifting the finished part, those smooth surfaces of the frames which face each other slide upon each other. A slight compressibility of the frame prevents jamming when lifting the finished plate, which jamming is possible by slight tiltings.

For purposes of pressing in the mortar, the thermoplastic material, or for filling in sand, pebbles, steel balls or the like, the finished parts are equipped with vertical openings or cavities.

The detaching of the finished part, especially after an already effected lifting of the finished part and the new filling of the space between the finished part and the supporting plate with a thermoplastic material can be facilitated according to the invention by a heating coil provided at the bottom side of the finished part. This heating coil makes it possible that thermoplastic material already in said space is returned from its hardened condition again into a flowable condition; alternately, the newly filled in material is kept in such an easily flowable condition that a deep, satisfactory filling up of said space will be possible.

Inasmuch as due to the lifting of the finished plate there exists the possibility that the original bolts by means of which the finished part was connected to the supporting plate may become too short, it may be necessary after the adjustment to employ new, longer bolts. However, it is also possible to screw studs or dowel pins into the dowels or pegs of the supporting plate. The threaded portion of such studs or dowel pins or pegs will after the lifting of a finished part still extend beyond the finished part to such an extent that they will be able to receive a nut.

Referring now to the drawings in detail and FIG. 1 thereof in particular, it will be seen that the holding means 4 having a rail engaging clamp 4' with the rail 5 are connected to the finished part 1 by means of screws 2 and dowels 3. The finished part 1 is connected by means of screws 6 and dowels 7 in the supporting plate 8. The side walls 9 of the finished part 1 taper conically in downward direction. The side walls and the bottom side are coated with a separating substance 10, e.g. a substance sold by the company Franz Voitländer, Germany, under the name Argonformenöl 700 CW; also a seal with epoxy resin may serve the purpose involved.

For practicing the method according to the invention, the rail 5 is lifted to the desired height after the bolts 6 have been disconnected. In view of the tapering side walls 9 and the separating layer 10, the finished part will, when being lifted, detach itself easier from its embedding in the supporting plate 8. The thus formed space or cavity 11 can now be filled by pressing-in mortar through the opening 12. The method may also be repeated. By pressing-in compressed air or water through the opening 12 prior to the lifting step proper, a detachment of the finished part is obtainable which will facilitate the following lifting operation.

When using thermoplastic material for filling the space 11 between the finished part or concrete support means 1 and the supporting plate or reinforced concrete plate 8, the lifting and the filling can be facilitated by providing a heating coil 13 at the bottom side of the finished part or concrete support means by means of which the hardened material can be softened again and the newly filled-in material can be kept in a readily flowing condition so that a deep and satisfactory filling of the space 11 can be realized. The heating of the heating coil may be effected by connection to a source of current, for instance, to connecting terminals 14 which project upwardly from the finished part. It is also possible to pass steam, hot oil, or a similar substance through a tubular heating coil.

The finished parts or concrete support means 1, 21 have metal reinforcements 1', 21' respectively therein. The supporting plates or reinforced concrete plates 8, 28 have metal reinforcements 8', 28' respectively therein and the plates 8, 28 are located on railway understructure **8*u*, 28*u*** respectively as shown in the drawings.

Referring now to FIG. 2, the rail holding means 24 having a rail engaging clamp 24' with rail 25 is connected to finished part 21 by means of screws 22 and dowels 23. The finished part 21 is connected by means of screws 26 and dowels 27 in the supporting plate 28. The bottom side of the finished part is provided with a plate 29 of synthetic material which is smooth on its bottom side and rough on its top side and which is provided with projections 30 for a better adherence in the concrete of the finished plate.

The side walls are surrounded by a frame 31 of synthetic material which has a smooth outer surface and a rough inner surface and which is provided with projections for a better adherence. The frame 31 with its outer smooth and inner rough surface will, during the lifting operation, adhere to the finished part. When the frame 32 is smooth on its inside and rough on its outside, it will during the lifting operation remain in the supporting plate. Although already with a frame 31 or a frame 32 a detachment of the finished part can be obtained during the lifting thereof, it is expedient to employ two frames in the form of a double-walled frame 31, 32 in which the smooth surfaces face each other and the rough surfaces are directed toward the outside. During the lifting operation, the outer frame 32 of the supporting plate will remain in the supporting plate, whereas the inner frame 31 adheres to the finished part and the smooth sides of the frames slide upon each other and relative to each other.

The filling-in of the space 33 between the finished part 21 and the supporting plate 28 again is carried out, after the lifting operation, by pressing-in filling material through the openings 34.

The embodiment shown in FIG. 2 has over the arrangement of FIG. 1 the advantage that the space or void created during the lifting operation is laterally sealed whereby the escape of mortar at the lateral surfaces will be prevented as it is possible with the arrangement of FIG. 1. With the embodiment of FIG. 2 there should, however, always be provided two openings 34 for the pressing-in operation, namely one opening for the pressing-in and the other opening for allowing escape of air and of mortar when the pressing operation has been completed.

For purposes of connecting the finished part to the supporting plate, FIG. 1 shows an ordinary screw 6 with a head. When the finished part is to be lifted by a greater distance, this screw 6 may have to be replaced by a new longer screw.

The screw 26 in FIG. 2 is a stud or dowel pin which is provided with a threaded portion 35 that projects beyond the finished part to such an extent that it is capable of receiving a nut 36 after the finished part has been lifted.

As will be evident from the above, the method and device according to the present invention bring about the great advantage that only the finished or the prefabricated part, to which the rail holding means 4 is connected by bolts 2, together with the pertaining rail or track section is to be lifted by the distance necessary for the respective required adjustment or correction, and the space 11 between the finished part 2 and the supporting plate 8 is to be filled with a filling substance, preferably mortar. As a result thereof, the filling substance will be located in a precisely defined space 11 (FIG. 1), namely between the supporting plate 8 and the finished part 1 proper. Consequently, a very precise dosing and thus a precise dimensioning of the height correction is possible. Experience has shown that so far only the method according to the invention has resulted in economically feasible conditions and permits technically highly satisfactory corrections in height with gravel-free railway upper structures which have been installed in the manner set forth in the introduction to the present invention, e.g. as disclosed in German Pat. No. 2,422,942.

It is, of course, to be understood that the present invention is by no means limited to the specific showing in the drawings but also encompasses any modifications within the scope of the appended claims.

What we claim is:

1. A method of correcting the height of railway upper structure including the building of a support structure comprising an understructure and an upper structure for railway tracks, which includes in combination the steps of: preparing an understructure for a railway track, pouring a reinforced concrete plate upon said understructure, embedding prefabricated reinforced concrete support means in said freshly poured reinforced concrete plate, placing rail holding means and anchoring same in said reinforced concrete support means to provide a support upper structure, and fastening the rails of said railway track by said rail holding means to said concrete support means, detaching said reinforced concrete support means from said reinforced concrete plate, lifting said reinforced concrete support means together with the pertaining rail section the height of which is to be corrected by a distance corresponding to the corrective height to be established, filling the thus created void between said reinforced concrete support means and said reinforced concrete plate with a filler, reconnecting said concrete support means to said reinforces concrete plate, and selecting as a filler a filling substance from sand, gravel, and steel balls.

2. A method in combination according to claim 1, in which said filling includes using a hardenable filler.

3. A method in combination according to claim 2, which includes selecting as hardenable filler from mortar and thermoplastic material.

4. A method in combination according to claim 3, which includes selecting as hardenable filler from bitumen and tar.

5. A support structure for correcting height of unballasted railway tracks which comprises an upper structure including: a reinforced concrete plate, reinforced concrete support means having a bottom side and detachably inserted in said reinforced concrete plate, filling means of hardened material that can be softened again and located between said reinforced concrete plate and said reinforced concrete support means, rail holding means connected to said reinforced concrete support means for detachably holding railway rails in position, fastening means for detachably holding said concrete support means to said reinforced plate, and a heating coil arranged between said reinforced concrete support means and said reinforced concrete plate, said heating coil being provided to soften hardened material of said filling means to facilitate lifting and filling at the bottom side of said reinforced concrete support means.

6. A support structure according to claim 5, in which said reinforced concrete support means has a bottom side and lateral surfaces covered by a separating substance for facilitating the separation of concrete bodies from each other.

7. A support structure according to claim 5, in which said reinforced concrete support means has a bottom side and a plate of synthetic material arranged on said bottom side, said last mentioned plate having a smooth bottom face and a rough top face with projections anchored in said reinforced concrete support means.

8. A support structure according to claim 5, in which said reinforced concrete support means has lateral surfaces, and in which a frame of synthetic material is arranged on said lateral surfaces, said frame having a smooth side and an oppositely located rough side provided with anchoring means.

9. A support structure according to claim 5, in which said reinforced concrete support means has lateral surfaces, and in which a double-walled frame of synthetic material is arranged on said lateral surfaces, said double-walled frame having smooth inner surfaces mutually engaging each other and rough outer surfaces provided with projections respectively anchored in said reinforced concrete support means and said reinforced concrete plate.

10. A support structure according to claim 5, in which said reinforced concrete support means is provided with passage means extending from an accessible outside surface of said reinforced concrete support means to a surface of said reinforced concrete plate.

11. A support structure according to claim 5, which includes: dowel means anchored in said reinforced concrete plate, and dowel pins having a first thread at one end thereof for engagement with said dowel means and a second thread at the other end projecting beyond said reinforced concrete support means for threaded engagement with a nut, said dowel pin projecting beyond said reinforced concrete support means to such an extent as to be able still to receive a nut after a height correction of said support structure has been effected.

* * * * *